US005663932A

United States Patent [19]

Weng

[11] Patent Number: 5,663,932

[45] Date of Patent: Sep. 2, 1997

[54] RESCUE WATCH

[76] Inventor: Nan-Te Weng, Fl.2-2, No.25, Alley 5, Lane107, Sec.1, Fu-Hsing S. Rd., Taipei, Taiwan

[21] Appl. No.: 662,608

[22] Filed: Jun. 13, 1996

[51] Int. Cl.[6] ..... G04B 47/00; G04B 37/00; A41F 9/00

[52] U.S. Cl. ..... 368/10; 368/282; 2/312

[58] Field of Search ..... 368/10, 281, 282; 2/311–317; 224/163

[56] References Cited

U.S. PATENT DOCUMENTS 4,058,972 11/1977 Weick ..... 368/278
4,813,899 3/1989 Fujimoto ..... 441/122
5,305,292 4/1994 Reynoso ..... 368/281

*Primary Examiner*—Vit W. Miska
*Attorney, Agent, or Firm*—Browdy and Neimark

[57] ABSTRACT

A rescue watch having a container chamber in which high pressure air or gas is stored, an air bag housed in a central cavity of the container chamber, a first button and a second button, a watch disposed on top of a pivotal cover member which is used to seal the central cavity in which the air bag is housed. High pressure air or gas can be introduced into the air bag when the first button is actuated, permitting the cover member to pivot open and the air bag to pop out instantly; and the gas or liquid for self defence can be discharged via a nozzle when the second button is actuated. The inflated air bag can keep a person floating in water in emergency waiting for rescue.

5 Claims, 4 Drawing Sheets

RESCUE WATCH

BACKGROUND OF THE INVENTION

The present invention relates to a rescue watch having a container chamber, a watch belt, a lid, a first button, a second button, a first valve means, a second valve means, an air bag and a nozzle. In the container chamber is housed high-pressure air liquid or gas for inflating an air bag or for self defence purpose. The air bag housed in a central cavity of the watch can be instantly inflated to keep a drowning person floating in water, or to use the high pressure liquid or gas to scare an assaulter away.

General watches are only used to tell time and no special functions can be performed in addition. Many self-defence tools mainly employed by women are carried along in purses, such as, electrical shock rod, tear gas can or gas of the like. Those tools are usually not at hand when a person is attacked by assaulters, they must be taken out of a purse or bag. Even a woman is well equipped with such guard tools, they become useless when they can not be reached in emergent need timely.

Besides, swimming in deep water and getting into trouble or plunged into water accidently, a drowning person can only cry for help and do nothing to himself usually.

SUMMARY OF THE INVENTION

Therefore, the primary object of the present invention is to provide a rescue watch equipped with an inflatable air bag housed in a central cavity of a container chamber containing high pressure air or gas so that when a button is actuated the air bag can be instantly filled with high pressure air and popped out so as to keep a drowning person floating in emergency.

Another object of the present invention is to provide a rescue watch which is equipped with gas or liquid discharged against an assaulter via a nozzle when a button is actuated for self defence.

DETAILED DESCRIPTION OF THE PREFERRED EMBODIMENT

Figure 1:
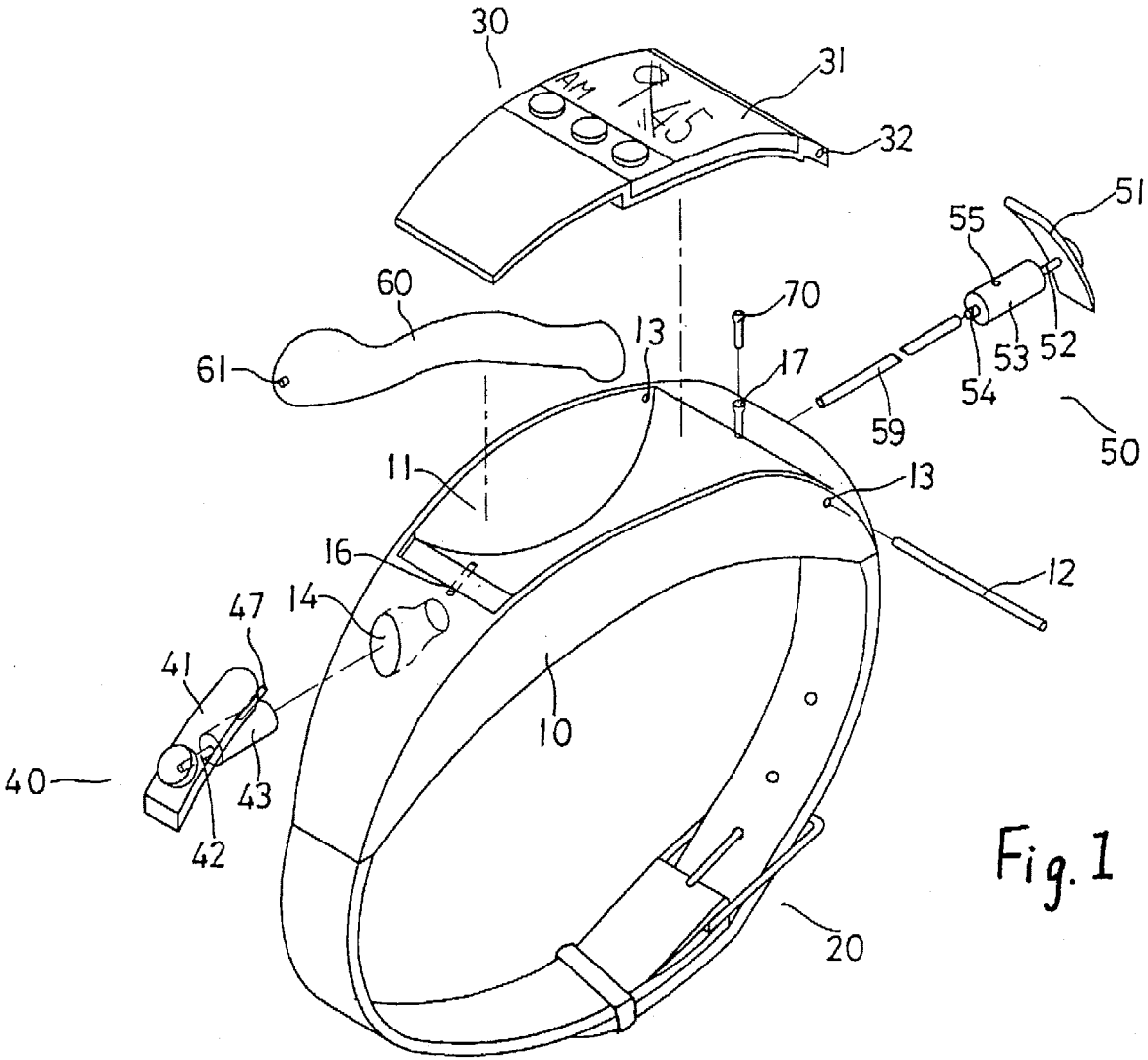
FIG. 1 is a diagram showing the exploded components of the present invention.
Figure 2:
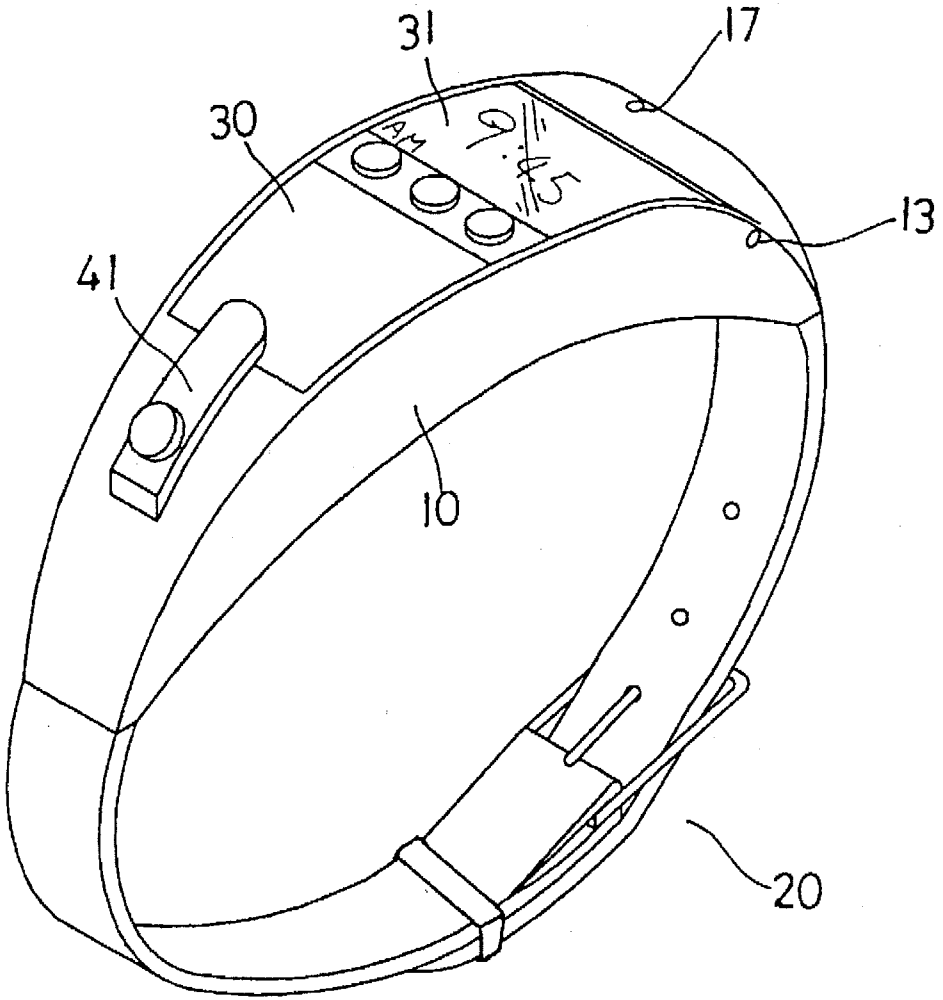
FIG. 2 is a diagram showing the assembly of the present invention.
Figure 3:
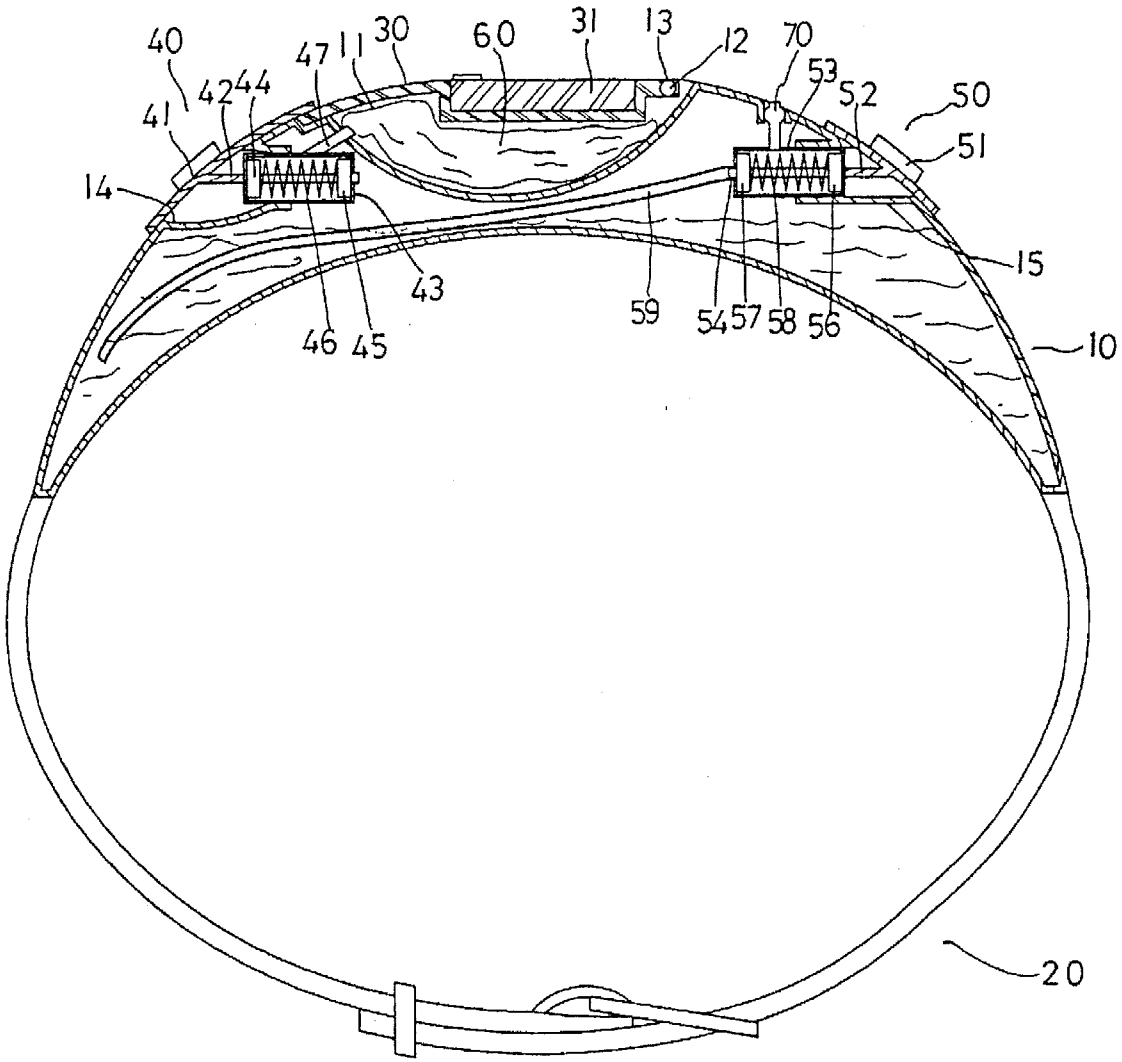
FIG. 3 is a sectional diagram of the present invention.

Referring to FIGS. 1, 2, 3, the rescue watch of the present invention is comprised of a container chamber 10, a watch belt 20, a cover member 30, a first button 40, a second button 50, an air bag and a nozzle 70.

The container chamber 10 is hollow inside with the watch belt 20 engaged with the ends thereof. At the center of the housing chamber 10 is provided with a central cavity 11. Two opposite holes 13 are defined on the corner of the central cavity 11 whereby a pin 12 can be secured in place. A first receiving hole 14 as well as a tubular hole 16 is defined at one end of the central cavity 11 for housing a cylinder member 43 and an external tube 47 of the first button 40 respectively. At the other end of the central cavity

11 is disposed a second receiving hole 15 and a vertical tubular hole 17 disposed adjacent thereto for housing a cylinder member 53 and the nozzle 70. The cylinder member 53 has a hole 55 is defined in such a manner that the nozzle 70 placed in the vertical tubular hole 17 can communicate with the hole 55 of the cylinder member 53.

The watch belt 20 is connected to the two ends of the receiving chamber 10. The cover member 30 is pivotally placed on top of the central cavity 11 with a waterproof watch 31 attached thereto. At one end of the cover member 30 are disposed two pivot holes 32 defined in correspondence to the holes 13 for securing of the pin 12.

Referring to FIG. 3, the first button 40 has a Y-shaped structure and is made up of a mounting panel 41 used also as a latch arm, a pull rod 42 and a tubular member 43. Referring further to FIG. 1, one end of the pull rod 42 extends into the tubular member 43 with a first piston member 44 and a second piston member 45 securedly engaged therewith and a compression spring 46 is disposed between the first and second pistons. The second piston member 45 has a central protrusion. A tube 47 engaged with a tubular hole 16 defined on the receiving chamber 10 slantly extends from the tubular member 43. The tube 47 is further extended into the central cavity 11 of the receiving chamber 10 and is in communication with the air inlet 61 of an air bag 60.

The second button 50, as shown in FIG. 3, has a mounting panel 51, a pull rod 52, a tubular member 53. One end of the pull rod 52 extends into the tubular member 53 and is securedly engaged with a first piston 56 and a second piston 57 having a central protrusion. A compression spring 58 is disposed between the first and second pistons. A nozzle 70 is engaged with a hole 55 of the tubular member 53. A connection tube 54 is disposed at the front end of the tubular member 53 with which is engaged an elongated pipe 59.

The air bag 60 made of tough and pressure durable flourescent material for easy location is provided with a coupling port 61 so as to permit the tube 47 to be engaged therewith.

Figures 4, 4A:
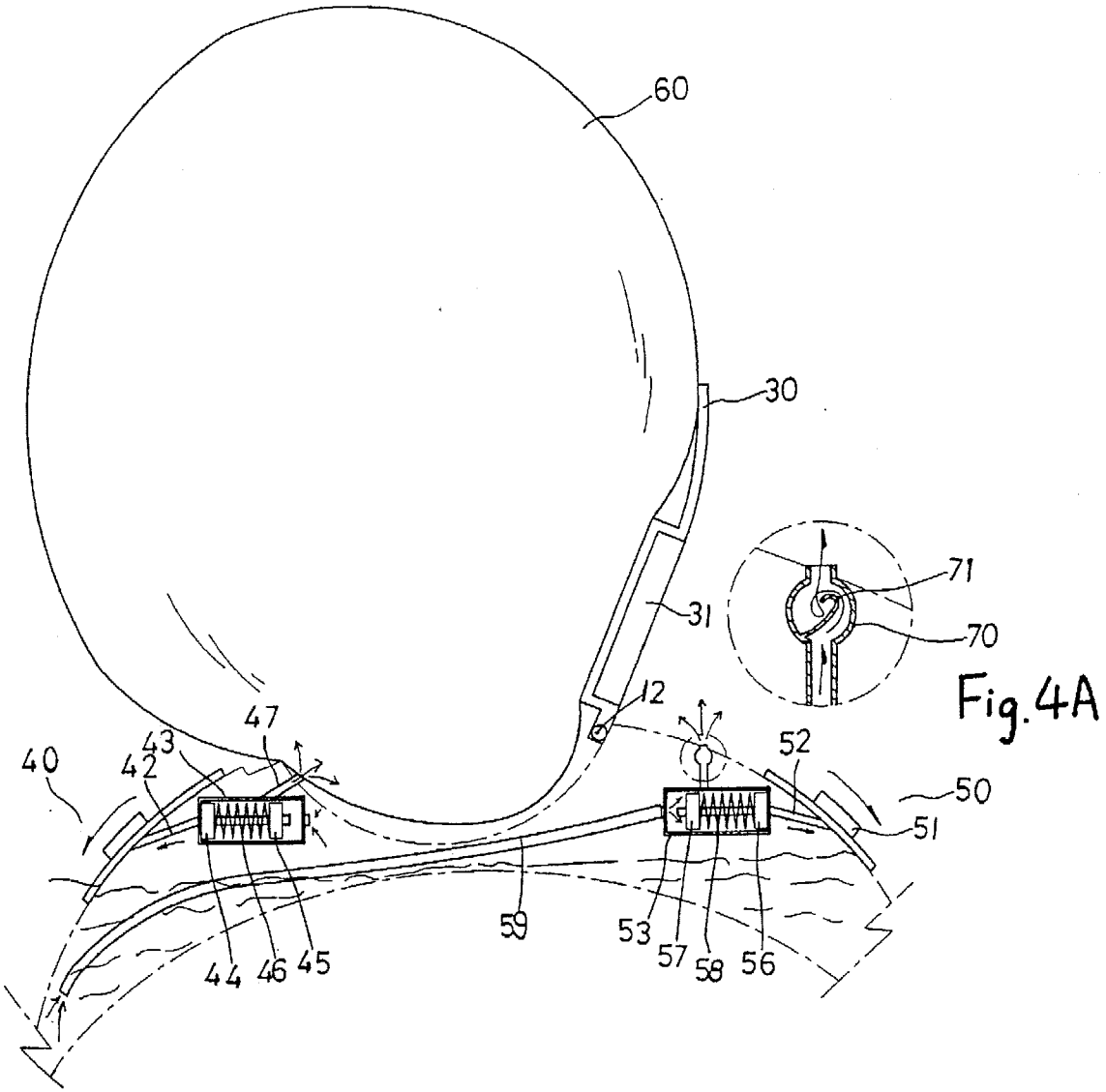
FIG. 4 is a diagram showing the practical operation of the present invention.
FIG. 4A is an enlarged diagram showing the detailed structure of the nozzle.

The nozzle 70 is a small hollow tubular piece 70 having a bulged end for housing a vibrational diaphram 71 which can produce high frequency alarm sound, as shown in FIG. 4A, the cited components are arranged in such an order as to constitute a rescue watch of the present invention.

Referring to FIG. 4, a practical operation of the present invention is illustrated. The rescue watch of the present invention can be worn and used as a common watch. When falling into water by accident and drowning, a person wearing the watch pushes the first button 40 downwardly, in a direction indicated by an arrow, permitting the latch arm 41 to disengage from the cover member 30 so as to free the cover member 30. In the meanwhile, the pull rod 42 drives the second piston 45 to move backwardly so as to permit high pressure air to rush into the closed tubular member 43 via a port 48 once sealed by the central protrusion of the second piston 45. The tubular member 43 communicates with the tube 47 which is further in communication with the air bag 60 so that high pressure air or is charged into the air bag 60 instantly, making the air bag 60 to be inflated in a very short period of time. A person can hold the air bag 60 only with one hand and keep his or her head above water waiting for rescue. Besides, the air bag 60 is made of material added with flourescent substance so that it will be spotted easily no matter in the day time or at night, increasing the chance of rescue effectively.

Furthermore, the rescue watch can also be used for self defence, in case a female wearing the rescue watch of the present invention is assaulted by rascals, she can point the nozzle 70 at the eyes or noses of the people and push downwardly the second button 50 so as to permit high pressure gas or liquid to be introduced into the tubular member 53 by way of the pipe 59 and discharged via the nozzle 70. At the same time, the vibrational diaphram 71 housed in the nozzle 70 can produce alarm at high frequency so as to scare the assaulters away.

I claim:

1. A rescue watch comprising:

a watch belt;

a container chamber in which high pressure air or gas or liquid is stored being connected to said watch belt;

said container chamber having a first receiving hole and a second receiving hole;

a central cavity disposed on top of said container chamber;

a deflated air bag housed in said central cavity;

a pivotal cover means disposed on top of said central cavity being locked by a latch means;

a watch being disposed on top of said pivotal cover means;

a first valve means engaged with said first receiving hole and in controllable communication with said container chamber and said air bag and being controlled by a first button;

said first button being connected to said latch means and said first valve means whereby the actuation of said fist button can make said pivotal cover opened and said air bag inflated by air or gas in said container chamber;

a second valve means engaged with said second receiving hole and in controllable communication with said container chamber and a nozzle means;

a second button connected to said second valve means;

said air or gas in said container chamber being led into said nozzle upon second button being actuated whereby gas can be discharged against an assaulter by pointing said nozzle at eyes or nose of said assaulter.

2. A rescue watch as claimed in claim 1 wherein both said first valve means and said second valve means are a tubular member having a first piston means and a second piston means which has a central protrusion housed therein with a spring disposed therebetween, and having an outlet port leading to said air bag or said nozzle respectively; said second piston means is rigidly fixed to one end of a rod which is connected to said first button and said second button respectively and said rod is slidably engaged with said first piston means so that each said second piston is sealedly engaged with an inlet port defined at the front end of each said tubular member by way of said central protrusion and can be pulled backwardly when said first or second button is actuated, permitting air or gas contained in said container chamber to rush into said air bag or said nozzle via said tubular member.

3. A rescue watch as claimed in claim 1 wherein both said first button and second button are provided with a mounting panel and said mounting panel of said first button also serves as a latch arm which retains said pivotal cover member in place and permits said cover member to open with said air bag popping out when inflated by way of actuation of said first button.

4. A rescue watch as claimed in claim 1 wherein said nozzle is provided with an alarm means which can produce high frequency alarm sound when high pressure air or gas is led through said nozzle.

5. A rescue watch as claimed in claim 1 wherein said air bag is made of a material containing fluorescent substance so that said air bag can be spotted in dark.

* * * * *